US006895920B2

(12) United States Patent
Pierro

(10) Patent No.: US 6,895,920 B2
(45) Date of Patent: May 24, 2005

(54) OIL SUMP

(76) Inventor: Enzo Pierro, 12, Halls Close, Drayton, Nr. Abingdon, Oxon (GB), OX144LU ( * ) Notice: Subject to any disclaimer, the term of this patent is extended or adjusted under 35 U.S.C. 154(b) by 0 days.

(21) Appl. No.: 10/459,637

(22) Filed: Jun. 11, 2003

(65) Prior Publication Data

US 2004/0069265 A1 Apr. 15, 2004

(30) Foreign Application Priority Data

Jun. 13, 2002 (GB) ..... 0213535

(51) Int. Cl.[7] ..... F01M 1/12
(52) U.S. Cl. ..... 123/195 C; 180/106; 184/69.1
(58) Field of Search ..... 123/195 C, 196 R; 184/106; 180/69.1

(56) References Cited

U.S. PATENT DOCUMENTS 4,479,463 A * 10/1984 Curley et al. ..... 123/195 C
5,236,061 A * 8/1993 Haupt ..... 180/254
5,601,060 A * 2/1997 Smietanski et al. ..... 123/195 C
6,041,752 A 3/2000 Van Klompenburg
6,290,843 B1 9/2001 Lee et al.

FOREIGN PATENT DOCUMENTS

| | | |
|---|---|---|
| DE | 4016968 A1 | 5/1990 |
| EP | 0849440 | 11/1997 |
| EP | 1217180 A1 | 6/2001 |
| FR | 2639089 | 10/1989 |
| GB | 2114072 A | 1/1983 |
| JP | 590547 16 A | 9/1982 |
| WO | WO 99/50005 | 10/1999 |

* cited by examiner

*Primary Examiner*—Noah P. Kamen
(74) *Attorney, Agent, or Firm*—Woodard, Emhardt, Moriarty, McNett & Henry LLP

(57) ABSTRACT

An oil sump is disclosed for a structural engine of an agricultural vehicle. The underside of the sump is formed with a longitudinally extending downwardly concave tunnel to accommodate a propeller shaft. The tunnel divides the interior of the sump into two oil trays arranged one on each side of the tunnel. Oil passages are cast into the sump to connect the two trays to a common recirculation duct that leads to the intake side of the engine oil pump.

7 Claims, 2 Drawing Sheets

OIL SUMP

FIELD OF THE INVENTION

The present invention relates to an oil sump for the engine of an agricultural vehicle.

BACKGROUND OF THE INVENTION

Many agricultural vehicles, such as tractors, have so-called structural engines, that is to say engines that form a structural part of the vehicle chassis. In such vehicles, the engine does not only act as the prime mover for driving the vehicle but is relied upon to give strength to the vehicle chassis. The oil sump or oil pan of the engine is constructed as a heavy component made of cast metal which is used to add to the stiffness of the engine block.

The substantial oil sump adds to the overall height of the engine and leads to packaging problems in particular in an agricultural vehicle having a four-wheel drive system because the propeller shaft leading to the front axle needs to pass directly beneath the sump. This means that the engine block and with it the entire drive train have to be raised to allow clearance for the propeller shaft.

The present invention seeks to enable the sump to have a sufficient oil capacity to meet the needs of the engine without having to raise the whole engine block.

SUMMARY OF THE INVENTION

In accordance with the present invention, there is provided an oil sump for an engine of a vehicle, wherein the underside of the sump is formed with a longitudinally extending downwardly concave tunnel to accommodate a propeller shaft, the tunnel dividing the interior of the sump into two oil trays arranged one on each side of the tunnel.

The sump of the present invention is formed as a saddle that fits over the propeller shaft, so that instead of falling into a single tray positioned entirely above the propeller shaft, the engine oil collects in two trays which straddle the propeller shaft.

To allow oil to be drawn from both trays, two separate oil passages may be provided in the sump that connect the respective trays to a common oil recirculation duct. The latter duct communicates with the intake side of the engine oil pump.

Preferably, the sump is formed as a casting and the passages are formed as an integral part of the casting. It is still further preferred for the recirculation duct also to be cast as part of the sump.

The junction between the passages and the recirculation duct may conveniently be formed as a chamber into which the passages and the duct open. A screen or filter may suitably be press-fitted into the chamber to remove larger particles from the oil before it is recirculated to the engine.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
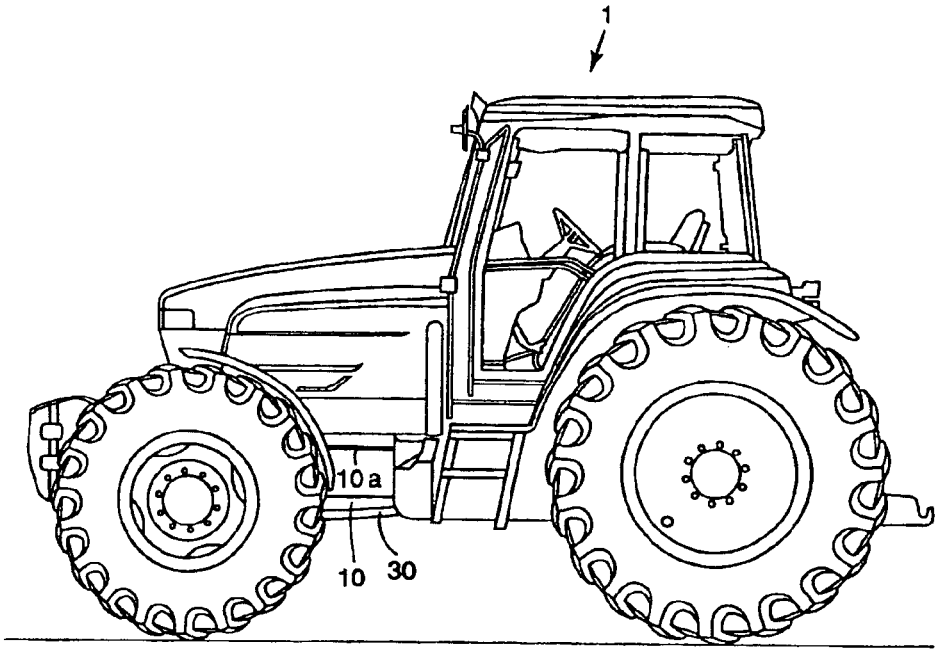
FIG. 1 is a side view of an agricultural tractor comprising a sump in accordance with the present invention.
Figure 2:
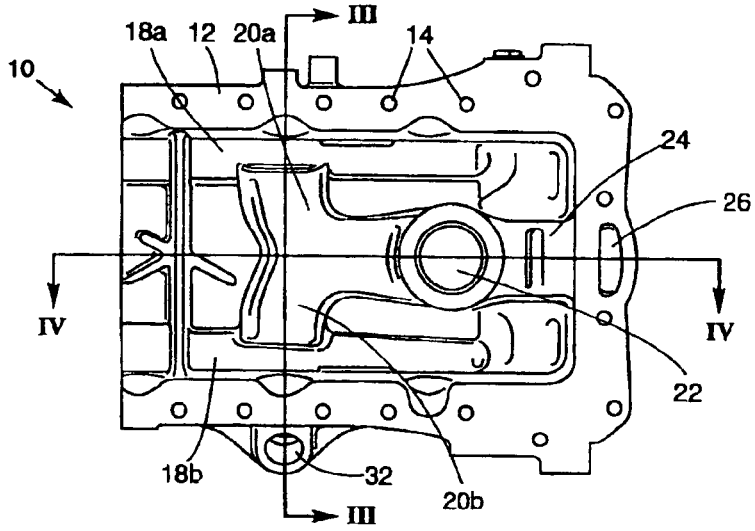
FIG. 2 is a plan view from above of a sump embodying the present invention.

The sump 10 shown in the drawings has a flange 12 at its upper end which in use is bolted to the underside of an engine block 10*a* of an agricultural tractor 1 by means of bolts (not shown) that pass through holes 14 formed at intervals in the flange 12.

The engine block is a major component of an engine providing a prime mover for the agricultural tractor 1. The engine is typically a reciprocating internal combustion engine in which a pressurized lubrication system receives lubricant from the sump 10 filters it, cools it, and delivers it to the rotating and moving components in the engine. The lubricant returns to the sump 10 where it again goes through the lubrication cycle. Preferably the engine block provides a structural function for tractor 1.

Figure 3:
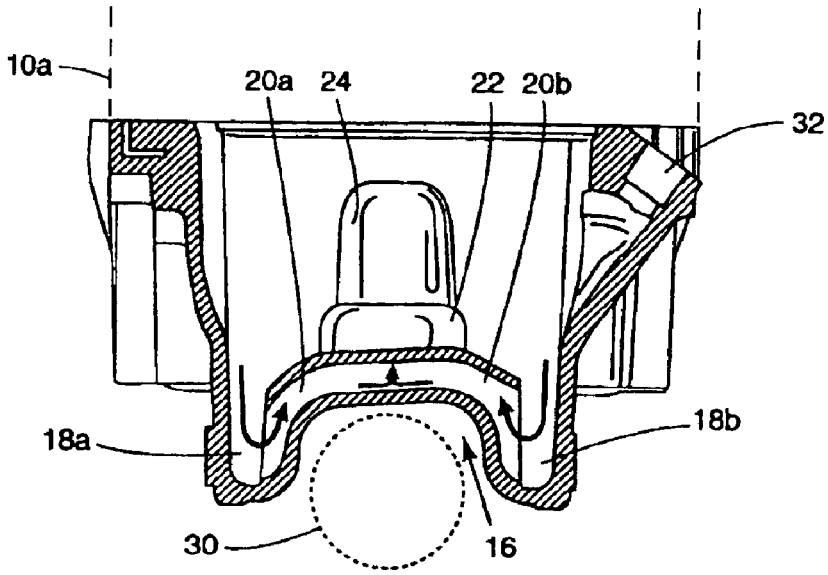
FIG. 3 is a section taken along the line III—III in FIG. 2.
Figure 4:
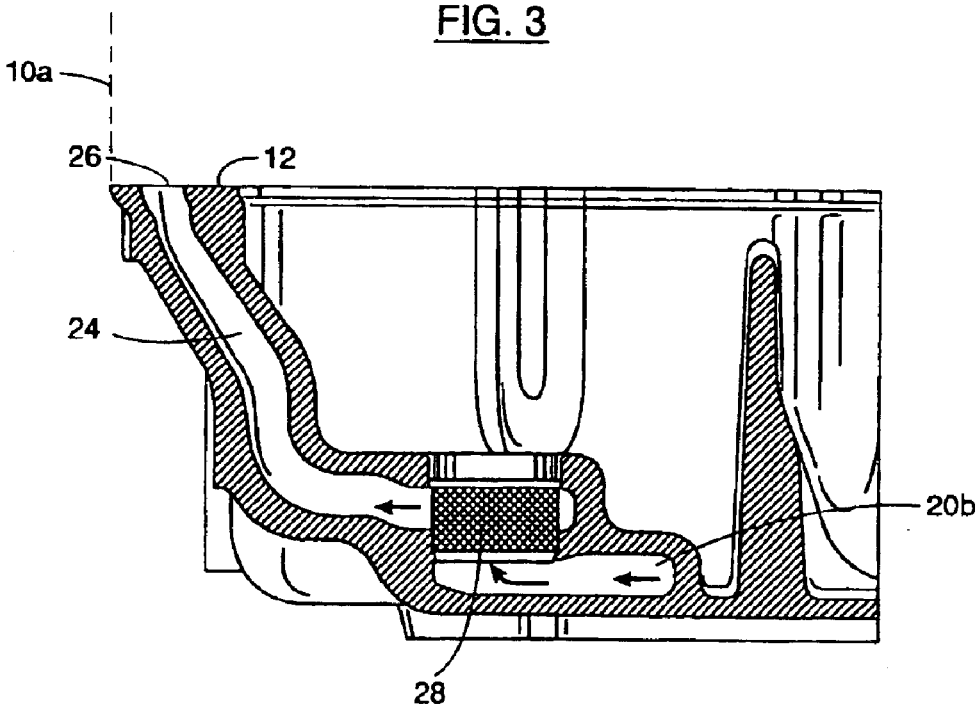
FIG. 4 is a section taken along the line IV—IV in FIG. 2 after insertion of a filter.

Whereas a conventional sump would be formed with a flat-bottomed drip tray extending across the width of the engine block, the bottom of the oil tray of the sump of the preferred embodiment of the invention, as is best shown in FIG. 3, is shaped like a saddle. In particular, the underside of the sump defines a concave tunnel 16 that faces downwards and within which the sump oil collects in two elongate trays 18*a* and 18*b* that lie one on each side of the tunnel 16.

The oil that drips into the trays from the engine block is recirculated by means of an oil pump (not shown) that is mounted on the engine block 10*a* (shown in dashed lines) and draws oil from the two trays 18*a* and 18*b*. For this purpose, two passages 20*a* and 20*b*, are cast into the block and lead from the respective trays 18*a* and 18*b* to a common plenum or chamber 22. A recirculation duct 24 having a mouth 26 that opens into the flange 12, is also cast as part of the sump to connect the chamber 22 to the oil pump. A gasket may be provided around the mouth 26 for making the connection between the duct 24 and the oil pump fluid-tight.

A filter 28 is press-fitted into the chamber 22 so that oil drawn from both oil trays 18*a* and 18*b* has to pass through the filter 28 before entering the duct 24 for recirculation by the oil pump.

The tunnel on the underside of the sump is dimensioned to accommodate a propeller shaft as represented in dotted lines at 30 in FIG. 3. In this way, the oil trays 18*a* and 18*b* can straddle the propeller shaft 30 that leads to the front axle instead of being located above it. This avoids the need for the engine and transmission to be raised to allow clearance for the propeller shaft 30.

The illustrated sump 10 is also formed with an access tube 32 for a dipstick. The positioning of the access tube permits the use of a short and therefore convenient dipstick that reaches directly into the tray 18*b*.

The provision of the duct 24 as integral part of the sump 10 reduces the number of components as otherwise a separate suction tube would be required. Furthermore, it facilitates assembly of the sump 10 in the narrow space inbetween the engine block and the propeller shaft 30, enabling it to be carried out as a blind operation, without running the risk of damaging the suction equipment.

The entrances of passages 20*a* and 20*b* reach deep into the oil trays 18*a* and 18*b*, ensuring that even with an exceptionally low level of oil in the sump 10 or on a transverse incline, sufficient oil is present to prevent air from entering the oil pump.

Having thus described the invention, what is claimed as novel and desired to be secured by Letters Patent of the United States is:

1. A cast oil sump for an engine of a vehicle, and wherein the outer underside of the sump is formed with a longitudinally extending downwardly concave tunnel to accommodate a propeller shaft, the tunnel dividing the interior of the sump into two oil trays arranged one on each side of the tunnel, said sump having two separate integral oil passages connecting the respective oil trays to a common oil recirculation duct along the upper side of the concave tunnel.

2. An oil sump according to claim 1, wherein the recirculation duct is also cast as part of the sump.

3. An oil sump according claim 2 wherein the junction between the oil passages and the recirculation duct is formed as a chamber into which the oil passages and the duct open.

4. An oil sump according to claim 3, wherein a filter is mounted in the chamber to filter oil drawn from the trays for recirculation to the engine.

5. An oil sump according to claim 1 wherein the recirculation duct has a mouth that opens into a mounting flange of the sump for connecting said duct to an engine oil pump.

6. Apparatus according to claim 1, further comprising a structural engine of an agricultural vehicle to which the sump is attached.

7. Apparatus according to claim 6, further comprising a propeller shaft driving at least some of the wheels of the vehicle.

* * * * *